US011170747B2

(12) United States Patent
Yamada

(10) Patent No.: US 11,170,747 B2
(45) Date of Patent: Nov. 9, 2021

(54) SOUND CONTROL DEVICE, SOUND CONTROL METHOD AND PROGRAM

(71) Applicant: Yamaha Corporation, Hamamatsu (JP)

(72) Inventor: Yuji Yamada, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 16/738,102

(22) Filed: Jan. 9, 2020

(65) Prior Publication Data

US 2020/0227016 A1 Jul. 16, 2020

(30) Foreign Application Priority Data

Jan. 10, 2019 (JP) ..... JP2019-002972

(51) Int. Cl.
*G10H 1/34* (2006.01)
*G10H 1/00* (2006.01)
*G10B 3/12* (2006.01)

(52) U.S. Cl.
CPC ..... *G10H 1/34* (2013.01); *G10B 3/12* (2013.01); *G10H 1/0008* (2013.01); *G10H 1/0075* (2013.01)

(58) Field of Classification Search
CPC ..... G10H 1/34; G10H 1/0008; G10H 1/0075; G10B 3/12
USPC ..... 84/423 R
See application file for complete search history.

(56) References Cited

U.S. PATENT DOCUMENTS 4,379,422 A * 4/1983 Munch ..... G10H 1/10 84/655
4,864,625 A * 9/1989 Hanzawa ..... G10H 1/187 381/61
4,966,051 A * 10/1990 Tajima ..... G10H 1/24 84/663
5,363,735 A * 11/1994 Kondo ..... G10H 1/36 84/622
5,552,560 A * 9/1996 Ura ..... G10H 1/24 84/653
5,633,985 A * 5/1997 Severson ..... A63H 5/00 446/297
7,915,514 B1 * 3/2011 Shrem ..... G10H 1/02 84/645
2010/0294112 A1 * 11/2010 Asakura ..... G10H 1/38 84/613
2020/0227016 A1 * 7/2020 Yamada ..... G10B 3/12

* cited by examiner

OTHER PUBLICATIONS

Yamaha Stage Piano, CP4 Stage, CP40 Stage, Reference Manual, Dec. 10, 2018, pp. 1-52, https://jp.yamaha.com/products/music_production/synthesizers/cp_series/downloads.html#product-tabs>, with English translation, 104 pages.

*Primary Examiner* — Christina M Schreiber
(74) *Attorney, Agent, or Firm* — Crowell & Moring LLP

(57) ABSTRACT

A sound control device includes a selector, a sound signal generator, a switcher, and a controller. The selector is configured to select, based on a user operation, one piece of setting information among a plurality of pieces of setting information including at least one timbre group and one effect setting group. The sound signal generator is configured to generate a sound signal based on performance information and the selected setting information. The switcher configured to switch between a hold-enabled state and a hold-disabled state based on a user operation. The controller configured to control the sound signal generator to generate the sound signal such that in the hold-enabled state, even if the selection of the setting information is switched by the selector, at least the effect setting is maintained.

17 Claims, 6 Drawing Sheets

SOUND CONTROL DEVICE, SOUND CONTROL METHOD AND PROGRAM

CROSS REFERENCE TO RELATED APPLICATION

This application is based upon and claims the benefit of priority of Japanese Patent Application No. 2019-2972 filed on Jan. 10, 2019, the contents of which are incorporated herein by reference in its entirety.

BACKGROUND OF THE INVENTION

1. Field of the Invention

The embodiments of the present invention relate to a sound control device, a sound control method, and a program configured to control a sound based on setting information configured by a combination of a timbre and an effect setting.

2. Description of the Related Art

A sound control device configured to control a sound based on setting information configured by a combination of a timbre and an effect setting is known in related art.

Non-Patent Literature 1: YAMAHA, product information, [online], synthesizer/music production, synthesizer/stage piano, CP STAGE/CP series, download, instruction manual, cp4 STAGE/CP40 STAGE reference manual [retrieved on Dec. 10, 2018], Internet <URL: https://jp.yamaha.com/products/music_production/synthesizers/cp_series/downloads.html#product-tabs>

SUMMARY OF THE INVENTION

When performing in a live hall, a performer may want to readjust a performance effect setting in accordance with an environment, such as an acoustic device of the hall. In this case, the performer may want to produce another performance while maintaining the readjusted effect setting. However, in the configuration of Non-Patent Literature 1, the performance and the effect setting are linked. For this reason, when the performer switches a performance, an effect setting is also switched to one effect setting registered in advance in the switched performance. That is, even if the effect setting is readjusted at a site, the readjusted effect setting is reset due to the switching of the performance. Therefore, flexibility for the performer to switch the effect setting is low.

One object of the present invention is to provide a sound control device, a sound control method and a program which can increase the flexibility in effect setting switching.

An aspect of the present invention provides a sound control device, including: a selector configured to select, based on a user operation, one piece of setting information among a plurality of pieces of setting information including at least one timbre group and one effect setting group; a sound signal generator configured to generate a sound signal based on performance information and the selected setting information; a switcher configured to switch between a hold-enabled state and a hold-disabled state based on a user operation; and a controller configured to control the sound signal generator to generate the sound signal such that in the hold-enabled state, even if the selection of the setting information is switched by the selector, at least the effect setting is maintained, whereas in the hold-disabled state, the effect setting is switched in response that the selection of the setting information is switched by the selector.

According to the one aspect of the present invention, the flexibility in effect setting switching can be improved.

DETAILED DESCRIPTION OF THE EXEMPLARY EMBODIMENTS

An embodiment of the present invention will be described below with reference to drawings.

Figure 1:
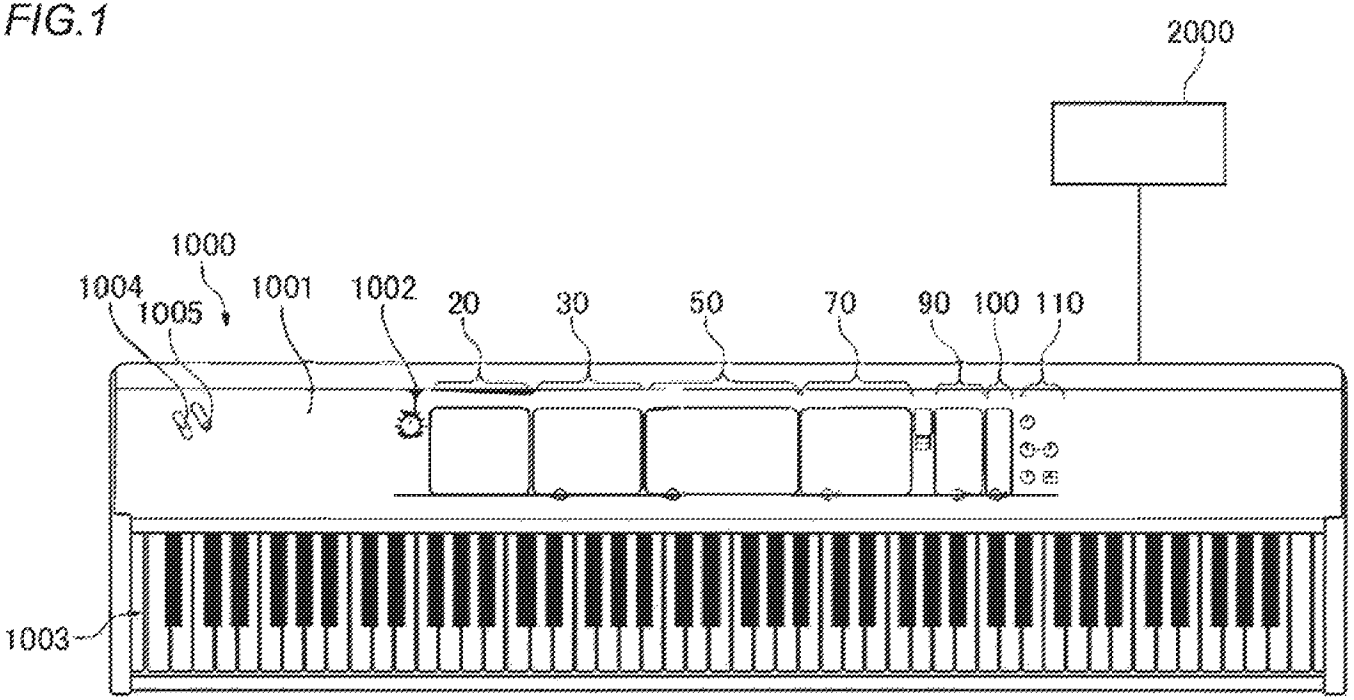
FIG. 1 is a configuration diagram of a sound control system including a sound control device.

FIG. 1 is a configuration diagram of a sound control system including a sound control device according to an embodiment of the present invention. The sound control system includes a keyboard device 1000 serving as the sound control device and an external device 2000, which are communicably connected to each other. The keyboard device 1000 is configured as an electronic keyboard instrument, for example. The keyboard device 1000 includes a keyboard unit 1003 including a plurality of keys. A master volume knob 1002, a pitch bend lever 1004, and a modulation lever 1005 are placed on a panel surface 1001 of the keyboard device 1000. The panel surface 1001 further includes a plurality of sections configured to receive various operations and settings. These sections include a main section 20, a first timbre section 30, a second timbre section 50, a third timbre section 70, a delay section 90, a reverb section 100, and a master equalizer (EQ) section 110.

Figure 2:
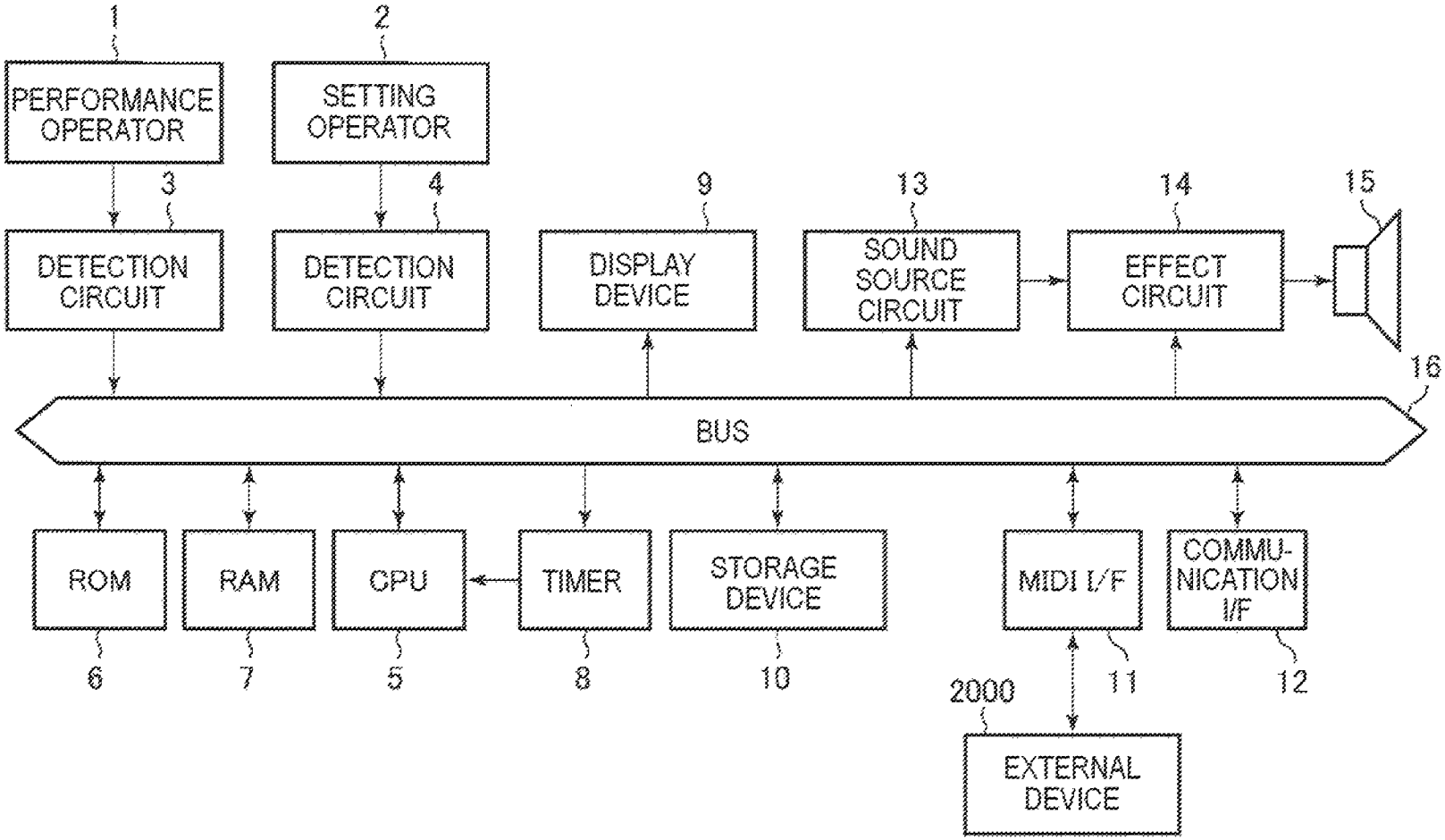
FIG. 2 is a block diagram showing an overall configuration of a keyboard device.

FIG. 2 is a block diagram showing an overall configuration of the keyboard device 1000. The keyboard device 1000 includes a detection circuit 3, a detection circuit 4, a ROM 6, a RAM 7, a timer 8, a display device 9, a storage device 10, and a musical instrument digital interface (MIDI) interface (MIDI I/F) 11. The keyboard device 1000 further includes a communication interface (communication I/F) 12, a sound source circuit 13, and an effect circuit 14. Components 3, 4, and 6 to 14 are connected to a CPU 5 via a bus 16.

A performance operator 1 configured to input pitch information is connected to the detection circuit 3. The performance operator 1 includes the keyboard unit 1003, the master volume knob 1002, the pitch bend lever 1004, and the modulation lever 1005 (FIG. 1). A setting operator 2 including a plurality of switches configured to input various types of information is connected to the detection circuit 4. The setting operator 2 includes a plurality of operators (described below with reference to FIGS. 2 and 3) included in each of the sections 20, 30, 50, 70, 90, 100, and 110. The display device 9 is configured by a liquid crystal display (LCD) or the like, and displays various types of information. The timer 8 is connected to the CPU 5. The external device 2000 can be connected to the MIDI I/F 11. The external device 2000 includes an external MIDI sound source. A server computer or the like can be connected to the communication I/F 12 via a communication network (not shown). A sound system 15 is connected to the sound source circuit 13 via the effect circuit 14. The sound system 15 may be incorporated in the keyboard device 1000 or may be connected to the keyboard device 1000 as an external device.

The detection circuit 3 detects an operation state of the performance operator 1. The detection circuit 4 detects an operation state of the setting operator 2. The CPU 5 controls the entire device. The ROM 6 stores a control program executed by the CPU 5, various table data, and the like. The RAM 7 temporarily stores various input information such as performance data and text data, various flags or buffer data, and arithmetic results. The timer 8 measures an interrupt time in timer interrupt processing, and various times. The storage device 10 stores various application programs including the control program, performance information, various data, and the like. The storage device 10 includes a nonvolatile storage medium. The storage device 10 may be an incorporated storage device or an external storage device. The storage device 10 is, for example, a semiconductor memory, a flexible disk drive (FDD), a hard disk drive (HDD), a CD-ROM drive or a magneto-optical disk (MO) drive.

The MIDI I/F 11 inputs an MIDI signal from the external device 2000 or outputs the MIDI signal to the external device 2000. A MIDI message can be transmitted and received by connecting MIDI terminals of the keyboard device 1000 and the external device 2000 with each other via a MIDI cable. The MIDI message to be transmitted and received at least includes a control change message.

The sound source circuit 13 converts performance data input from the performance operator 1 or preset performance data (such as automatic performance data stored in the storage device 10) into a sound signal. The effect circuit 14 applies various effects to the sound signal input from the sound source circuit 13. The sound system 15, such as a digital-to-analog converter (DAC), an amplifier, or a speaker, converts the sound signal input from the effect circuit 14 into a sound. When a performance is performed using a performance described below, the CPU 5 uses the effect circuit 14 to apply an effect to a sound signal based on an effect setting defined in the performance.

Figure 3:
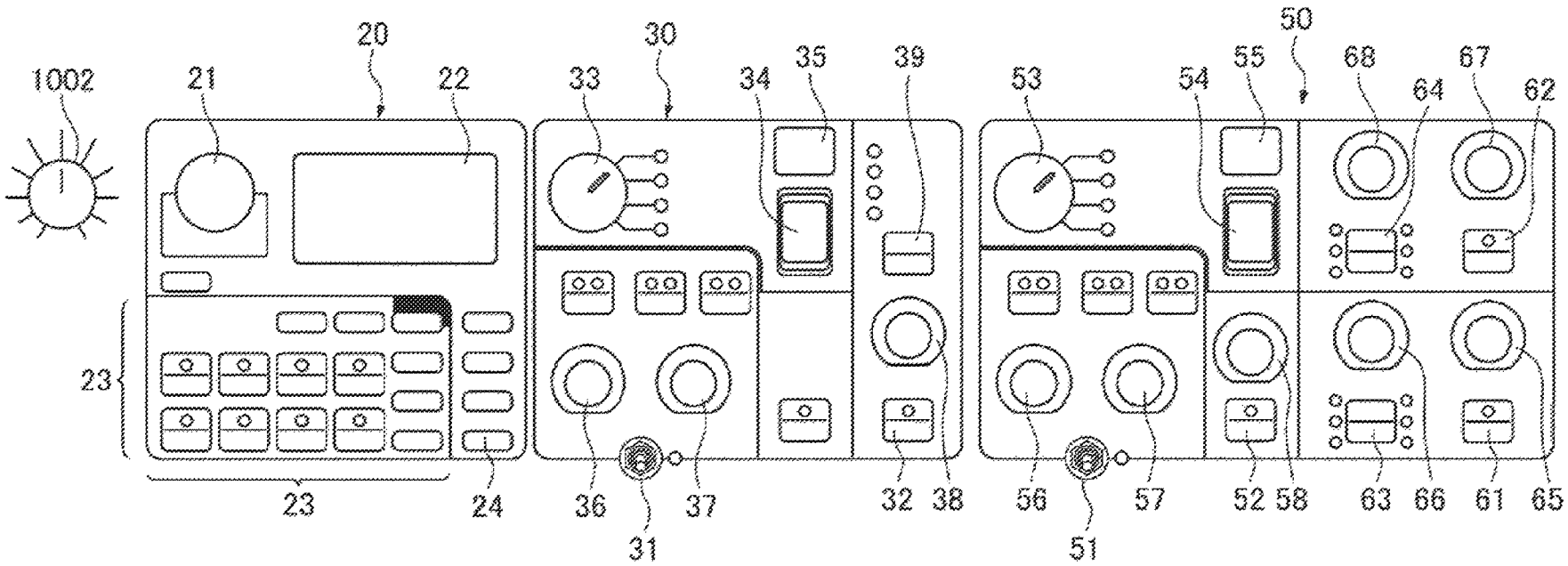
FIG. 3 shows main components placed on a panel surface of the keyboard device.
Figure 4:
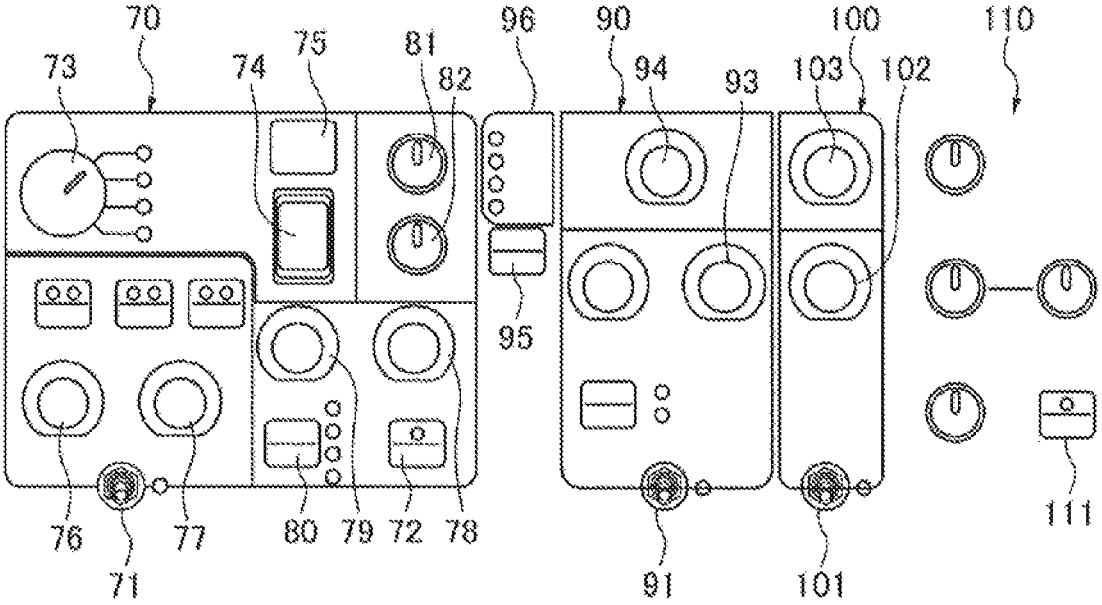
FIG. 4 shows main components placed on the panel surface of the keyboard device.

Next, configurations and functions of each section placed on the panel surface 1001 of the keyboard device 1000 will be described with reference to FIGS. 3 and 4. FIGS. 3 and 4 show main components placed on the panel surface 1001 of the keyboard device 1000.

The performance refers to information (setting information) including at least one timbre group and one effect setting group. At least one timbre and at least one effect setting belong to one performance. A plurality of performances are stored in advance (preset) in the ROM 6 or the storage device 10. A performer (hereinafter, also referred to as a user) can edit the stored performances and store the edited performances in the storage device 10 serving as a holding unit (a holder) so as to override the stored performances. The performer can also create a new performance and store the new performance in the storage device 10 serving as the holding unit so as to add the performance.

The effect setting refers to information related to types of effect and modes of application. The effect setting is set with respect to the included timbre for each performance. The effect setting includes settings of effect (such as an insertion effect), reverb, delay, and EQ. Effects to be set included as the effect setting are not limited to be plural as described above, and may be at least one effect. Types thereof are not limited to the above four types, and may be any type as long as the effect is applied to the timbre. For example, the effect setting may only include settings of reverb, delay, and EQ.

The main section 20 shown in FIG. 3 is used to make various settings in cooperation with other sections. The first timbre section 30, the second timbre section 50, and the third timbre section 70 shown in FIG. 4 are used to make settings for each timbre used for producing a sound. As an example, the first timbre section 30 is a piano section and is mainly used for setting timbres of acoustic pianos. The second timbre section 50 is an electric piano section and is mainly used for setting timbres of electric pianos. The third timbre section 70 is a subsection, and is mainly used for setting a timbre to be layered on a piano or an electric piano. The delay section 90, the reverb section 100, and the master EQ section 110 are effect sections configured to set an effect that is commonly applied to timbres to be produced (hereinafter, referred to as a common effect). In addition to the common effect, an insertion effect is also provided as an effect that can be specifically applied to each timbre section. The insertion effect is a type of effect that is specifically designed for each timbre section, and selection of the insertion effect in each timbre section will be described below.

As shown in FIG. 3, the main section 20 includes a dial 21, a main display 22, a selection switch group 23, and a menu button 24. The menu button 24 is used for displaying a screen configured to make setting for the entire system. When the dial 21 is rotated, an item is selected, and when the dial 21 is pressed, edited contents are determined. A setting screen is displayed on the main display 22, for example, the selected item or the edited contents are displayed. The selection switch group 23 includes a plurality of push buttons. The plurality of push buttons are used, for example, to invoke one of a plurality of registered performances.

The first timbre section 30 includes a timbre section ON/OFF switch 31, an insertion effect ON/OFF switch 32, a category selector 33, a timbre select switch 34, and a display 35. The first timbre section 30 further includes a volume knob 36, a tone knob 37, a depth knob 38, and an insertion effect switching switch 39.

The category selector 33 is a rotation operator configured to select a timbre category. The timbre select switch 34 is a switch configured to select one timbre from a timbre group belonging to the selected timbre category. The timbre section ON/OFF switch 31 is a switch configured to designate validity/invalidity of a timbre. When the validity of the timbre is designated, the timbre is to be produced. For example, in response to a performance of the keyboard section 1003, a sound of the timbre is produced. On the contrary, if the invalidity of the timbre is designated, the timbre is not produced. The timbre section ON/OFF switch 31 is, for example, a toggle switch operated by pressing or inclining. For example, when an operation ends, the timbre section ON/OFF switch 31 is returned to an original posture. On the display 35, a number indicating the currently selected timbre or the like is displayed.

The insertion effect switching switch 39 is a switch configured to switch the insertion effect to be applied to the timbre set in the first timbre section 30. As for the insertion effect mentioned here, a plurality of types are prepared, such as stereo compressor and distortion. The performer selects one insertion effect to be applied by operating the insertion effect switching switch 39. The insertion effect ON/OFF switch 32 is a switch configured to designate validity/invalidity of application of the insertion effect selected by the insertion effect change switch 39. Only when the application of the insertion effect is designated to be valid, the selected insertion effect is applied to the timbre set in the first timbre section 30.

The volume knob 36 is a rotation operator configured to adjust volume of the timbre. The tone knob 37 is a rotation operator configured to adjust a tone of the timbre. The depth knob 38 is a rotation operator configured to adjust a depth to which the insertion effect is applied.

The second timbre section 50 includes a timbre section ON/OFF switch 51, an insertion effect ON/OFF switch 52, a category selector 53, a timbre select switch 54, and a display 55. The second timbre section 50 further includes a volume knob 56, a tone knob 57, and a drive knob 58. The second timbre section 50 further includes insertion effect ON/OFF switches 61, 62, insertion effect switching switches 63, 64, a speed knob 65, a depth knob 66, a rate knob 67 and a depth knob 68.

Configurations and functions of the switches 51, 52, 54, the category selector 53, the display 55, and the knobs 56, 57 are the same as configurations and functions of the switches 31, 32, 34, the category selector 33, the display 35, and the knobs 36, 37. Configurations and functions of the switches 61, 62 are the same as a configuration and a function of the switch 32. Configurations and functions of the switches 63, 64 are the same as a configuration and a function of the switch 39.

The insertion effect ON/OFF switches 61, 62 are switches configured to designate validity/invalidity of application of insertion effects set by the insertion effect switching switches 63, 64 with respect to a timbre set in the second timbre section 50. An insertion effect, such as chorus or flanger, can be switched by the insertion effect switching switch 63. An insertion effect, such as auto panning or tremolo, can be switched by the insertion effect switching switch 64.

Configurations and functions of the depth knobs 66, 68 are the same as a configuration and a function of the depth knob 38. The speed knob 65 is a rotation operator configured to adjust a speed of the insertion effect. The rate knob 67 is a rotation operator configured to adjust the speed of the insertion effect.

As shown in FIG. 4, the third timbre section 70 includes a timbre section ON/OFF switch 71, an insertion effect ON/OFF switch 72, a category selector 73, a timbre select switch 74, and a display 75. The third timbre section 70 further includes a volume knob 76, a tone knob 77, a speed knob 78, a depth knob 79, an insertion effect switching switch 80, an attack knob 81, and a release knob 82.

Configurations and functions of the switches 71, 72, 74, 80, the category selector 73, the display 75, and the knobs 76, 77 are the same as configurations and functions of the switches 31, 32, 34, 39, the category selector 33, the display 35, and the knobs 36, 37. The insertion effect ON/OFF switch 72 is a switch configured to designate validity/invalidity of application of an insertion effect set by the insertion effect switching switch 80 with respect to a timbre set in the third timbre section 70. An insertion effect, such as chorus or rotary speaker, can be switched by the insertion effect switching switch 80.

A configuration and a function of the depth knob 79 are the same as the configuration and the function of the depth knob 38. A configuration and a function of the speed knob 78 are the same as a configuration and a function of the speed knob 65. The attack knob 81 is a rotation operator configured to adjust a time for a sound to start. The release knob 82 is a rotation operator configured to adjust a time for a sound to disappear.

An effect level switching button 95 and a lamp unit 96 are placed between the third timbre section 70 and the delay section 90. The effect level switching button 95 is a switch configured to select an effect whose send level is to be adjusted among delay and reverb. The lamp unit 96 includes three section lamps. A section lamp corresponding to a timbre section set as a target of the send level adjustment is lighted by the effect level switching button 95.

The delay section 90 includes a delay ON/OFF switch 91, a time knob 93, and a depth knob 94. The reverb section 100 includes a reverb ON/OFF switch 101, a time knob 102, and a depth knob 103. The ON/OFF switches 91, 101 are switches configured to switch whether to apply a delay effect or a reverb effect to a timbre corresponding to a valid timbre section among the timbre sections 30, 50, 70 (a timbre to be produced). In other words, the ON/OFF switches 91, 101 are designation operators configured to receive designation of validity/invalidity of a common effect (reverb, delay) defined in the selected performance.

The time knob 93 is a rotation operator configured to adjust a length of a feedback delay. The depth knob 94 is a rotation operator configured to adjust a depth to which a delay effect is applied. The time knob 102 is a rotation operator configured to adjust a length during which a reverb effect is applied. The depth knob 103 is a rotation operator configured to adjust a depth to which the reverb effect is applied.

A master EQ ON/OFF switch 111 of the master EQ section 110 is a switch configured to switch whether to apply a master EQ to the timbre corresponding to the valid timbre section among the timbre sections 30, 50, 70. By applying the master EQ, sound quality of an entire sound is corrected.

The volume set for each timbre section, the speed, length, depth of the insertion effect set for each timbre section are sound parameters set for the timbre corresponding to the timbre section. As described above, the target whose send level is to be adjusted can be switched by the effect level switching button 95. Therefore, the performer operates the knobs 93, 94, 102, 103 in a state where the section lamp corresponding to the timbre section whose send level is to be adjusted is lighted in the lamp unit 96. With such an operation, the sound parameters can be adjusted for each timbre section.

Next, operation examples at the time of invoking a performance, editing a performance, and adding a new performance will be described. The user selects one desired performance among a plurality of registered performances by operating the selection switch group 23 (FIG. 3). Then a name of the selected one performance is displayed on the main display 22. A performance of a selected state in an initial state, such as when the keyboard device 1000 is powered on, is determined in advance. When the user selects another performance by operating the selection switch group 23 while one performance is selected, the name of the newly selected performance is displayed on the main display 22 instead of the name displayed so far. In this way, the selected performance is switched by the operation of the selection switch group 23.

When editing the selected performance, the user can switch validity/invalidity for each timbre section, for example, by operating the timbre section ON/OFF switches 31, 51, or 71. The user can set a corresponding timbre for each timbre section by operating the category selectors 33, 53 or 73 and the timbre select switches 34, 54, or 74. Further, the user can set an insertion effect to be applied to each timbre section by operating the insertion effect switching switches 39, 63, 64, or 80. The user can switch validity/invalidity of the insertion effect for each timbre section by operating the insertion effect ON/OFF switches 32, 52, or 72. Further, the user can adjust sound parameters related to the volume and the insertion effect by appropriately operating the knobs 36 to 38, 56 to 58, 65 to 68, and 76 to 79.

The performance is reflected in a sound produced during performance even if the performance is being edited without being saved. In order to save the performance after editing, the user operates a store switch of the selection switch group 23. With this operation, a timbre section edited currently is saved. An update can be performed by overriding when the edited timbre section is stored and registered. A new timbre section having another name can be additionally registered. A function of a creating unit (a creator) configured to create the new timbre section based on an operation of the user is mainly realized by cooperation of the setting operator 2, the CPU 5, the ROM 6, the RAM 7, and the storage device 10. The setting of the master EQ may be included in the performance, or may not be included therein.

As an example, it is assumed that the performance is desired to be set to produce a layered sound including a sound in which a stereo compressor is added to a first grand piano sound and a sound in which no insertion effect is added to a first electric piano sound. Moreover, it is desired to apply a reverb without applying a delay to the timbre of the sound to be produced. In this case, the user makes a setting as follows.

First, the user sets the first grand piano sound as the timbre of the first timbre section 30, and sets the first electric piano sound as the timbre of the second timbre section 50. The user turns on the switches 31, 51 of the timbre sections 30, 50, and turns off the switch 71 of the third timbre section 70. The user turns on the insertion effect switching switch 39 and turns off the insertion effect ON/OFF switches 61, 62. The user turns off the delay ON/OFF switch 91 and turns on the reverb ON/OFF switch 101. In addition, the user appropriately operates the knobs or the rotation operators so as to adjust the sound parameters.

Figure 5:
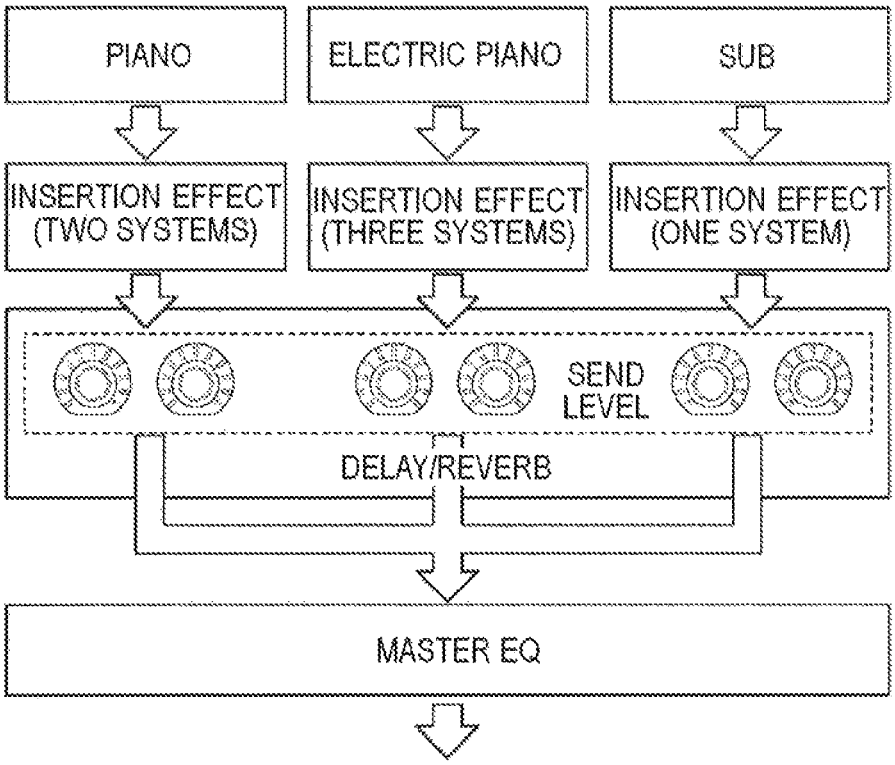
FIG. 5 is a conceptual diagram showing a flow of signals sent from each timbre section to a master EQ section.

FIG. 5 is a conceptual diagram showing a flow of signals sent from each timbre section to the master EQ section 110. The sound signals of the timbre corresponding to each timbre section are supplied to the effect section after unique insertion effects are applied to each timbre section. Then, a common effect corresponding to a set send level is applied to all of the signals supplied from each timbre section to the effect section. The signals to which the common effect is applied are output after EQ is applied thereto by the master EQ section 110.

Figure 6:
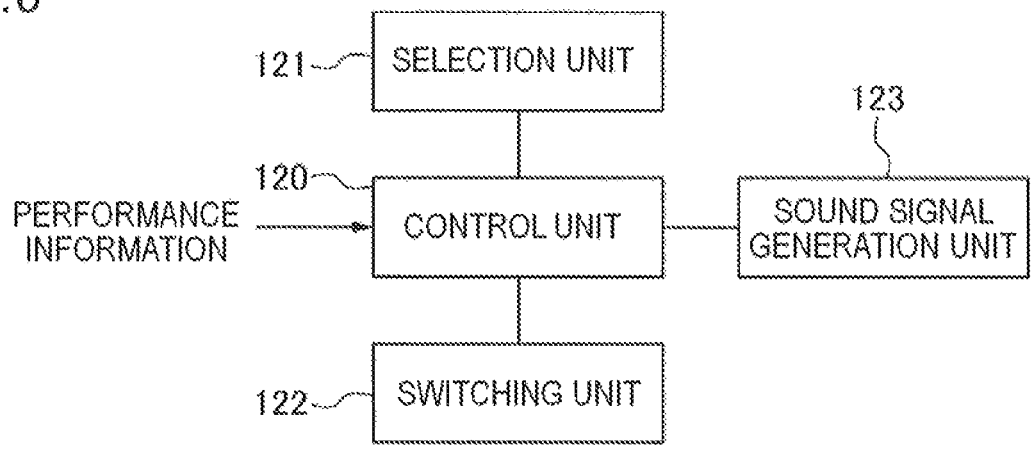
FIG. 6 is a block diagram of a functional configuration of the keyboard device.

FIG. 6 is a block diagram of a functional configuration of the keyboard device 1000. The keyboard device 1000 includes, as main functional blocks, a control unit (a controller) 120, a selection unit (a selector) 121, a switching unit (a switcher) 122, and a sound signal generation unit (a sound signal generator) 123. A function of the control unit 120 is realized mainly by cooperation of the CPU 5, the ROM 6, the RAM 7, the timer 8, and the storage device 10. A function of the sound signal generation unit 123 is realized mainly by cooperation of the CPU 5, the sound source circuit 13, and the effect circuit 14. The sound signal generation unit 123 generates a sound signal based on performance information and a selected performance. The performance information is input by the performance operator 1, for example. The performance information may also be acquired from the storage device 10 or acquired via the MIDI I/F 11. The sound signal generation unit 123 generates a sound signal having a timbre defined in the performance and a pitch based on the performance information. The sound signal generation unit 123 further applies an effect defined in the performance to the generated sound signal. The sound signal to which the effect is applied is converted into a sound by the sound system 15 so as to generate the sound.

A function of the selection unit 121 is realized mainly by cooperation of the setting operator 2, the CPU 5, the ROM 6, the RAM 7, and the storage device 10. The selection unit 121 selects one of a plurality of performances based on an operation of the user. Selection of performances according to an operation of the user performed by the selection switch group 23 corresponds to the function of the selection unit 121. A function of the switching unit 122 is realized mainly by cooperation of the setting operator 2, the CPU 5, the ROM 6, the RAM 7, and the storage device 10. The switching unit 122 switches between a "hold-enabled state" and a "hold-disabled state" based on an operation of the user. The CPU 5 controls operations in the hold-enabled state and the hold-disabled state. Switching between the hold-enabled state and the hold-disabled state according to an operation of the user performed by the switches 91, 101 corresponds to the function of the switching unit 122.

The hold-enabled state, the hold-disabled state, and a switching operation of the switching unit 122 will be described below. The hold-enabled state is a state in which, even if the performance is switched, at least an effect setting is maintained when a sound signal is generated by the sound signal generation unit 123. The hold-disabled state is a state in which the effect setting is switched in response to the switching of the performance as usual.

The switching unit 122 switches from the hold-disabled state to the hold-enabled state based on reception of a hold operation (a first predetermined operation) received by the delay ON/OFF switch 91 or the reverb ON/OFF switch 101. The hold operation is an operation different from the operation for designating the validity/invalidity of the effect. An operation of the delay ON/OFF switch 91 will be described as a representative example. An operation for designating the validity/invalidity of the delay effect is an operation of pressing the switch 91 once. The hold operation is an operation of pressing the switch 91 for a longer time than the normal operation of pressing the switch once (so-called long pressing). The switching unit 122 uses a threshold time to determine whether an operation is a normal press operation or a long pressing operation. When the hold operation is received, the switching unit 122 switches from the hold-disabled state to the hold-enabled state.

The switching unit 122 switches from the hold-enabled state to the hold-disabled state based on reception of a hold release operation (a second predetermined operation) in the hold-enabled state. The hold release operation is the same as the normal operation of pressing the switch 91 once, for example. The hold release operation may also be another operation different from the operation of pressing once (for example, an operation of pressing twice within a predetermined time).

The performer can distinguish the effect to be maintained by operating the switch 91 and operating the switch 101. For example, when the switch 91 is changed from the hold-disabled state to the hold-enabled state by long pressing of the switch 91, even if the performance is switched, the delay effect setting is maintained when the sound signal is generated. The insertion effect and the EQ are also maintained in the state before the switching. When the switch 101 is changed from the hold-disabled state to the hold-enabled state by long pressing of the switch 91, even if the performance is switched, the reverb effect setting is maintained when the sound signal is generated. The insertion effect and the EQ are also maintained in the state before the switching.

There are cases when the performer desires to adjust the effect setting in accordance with an environment of a hall or the like. The performer can temporarily change the effect setting of the currently selected performance by operating changing units (changers), such as the knobs 93, 94, 102, 103, at a site of a live hall. In this way, when the effect setting is temporarily changed, the effect setting is also maintained when the state is switched to the hold-enabled state. That is, even when the performance is switched, the temporarily changed effect setting is maintained when the sound signal is generated. Since the effect setting is not reset even when the performance is switched, convenience of the effect setting is improved for the performer.

When the effect setting does not include the setting of the insertion effect or the EQ, even if the performance is switched in the hold-enabled state, the setting of the insertion effect or the EQ is not an object to be maintained.

As for the common effect, all of the common effects may be maintained in the hold-enabled state. That is, it is assumed that either the switch 91 or the switch 101 is changed from the hold-disabled state to the hold-enabled state by long pressing. In this case, even if the performance is switched, the delay effect setting and the reverb effect setting are maintained in the state before the switching when the sound signal is generated. A mode of the switching operation is not limited to the exemplified long pressing. For example, the switching operation may be an operation of pressing twice within a predetermined time. The operators used in the switching between the hold-enabled state and the hold-disabled state may be operators other than the switches 91, 101. For example, an operator dedicated to the switching may be provided. A single operator may be used in the switching between the hold-enabled state and the hold-disabled state, and all of the common effects may be maintained in the hold-enabled state. That is, the operator used in the switching may be only one of the switch 91 or the switch 101.

Figure 7:
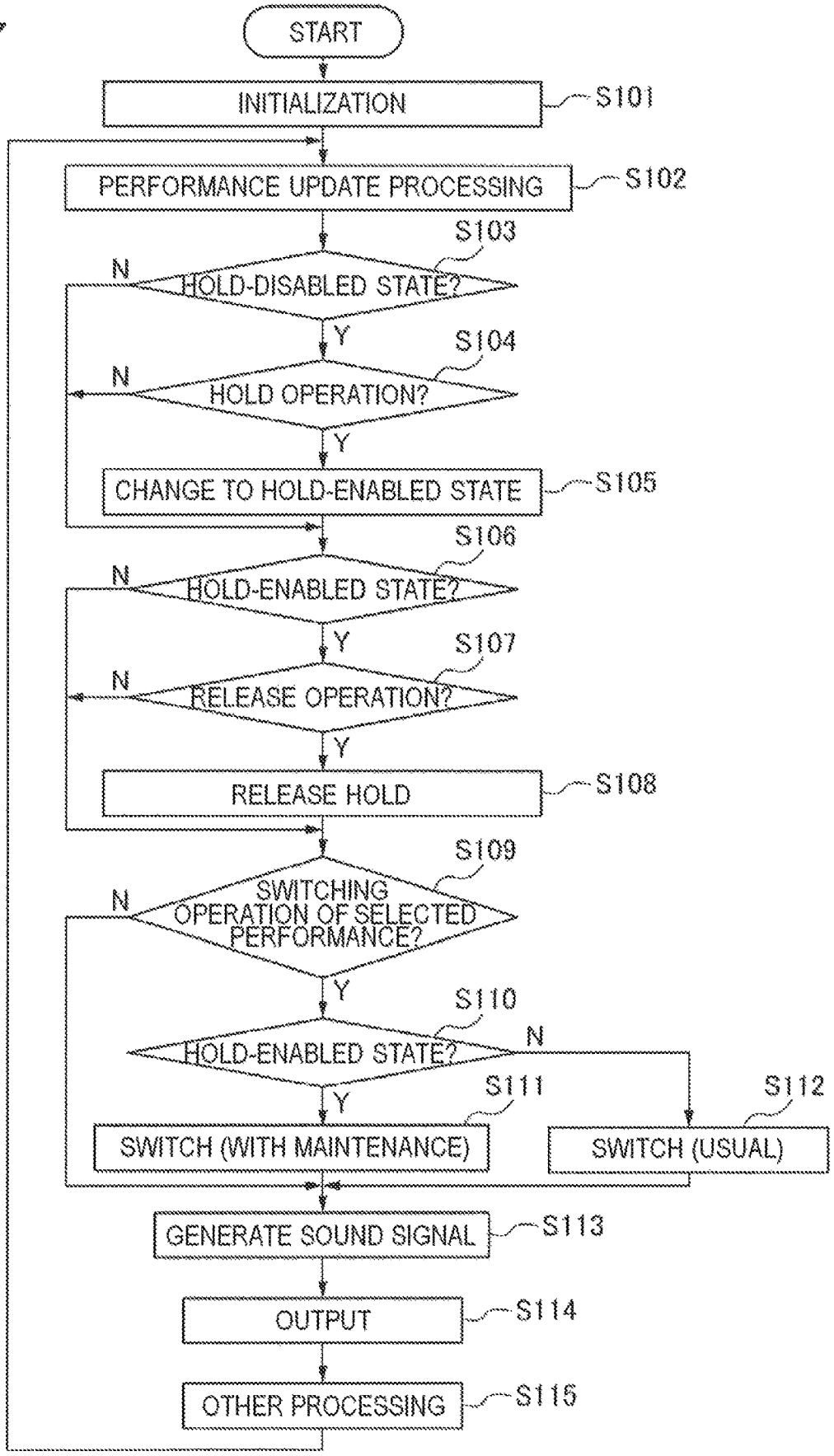
FIG. 7 is a flowchart of sound signal output processing.

FIG. 7 is a flowchart of sound signal output processing. The CPU 5 loads a program stored in the ROM 6 into the RAM 7 and executes the loaded program, so as to realize this processing. This processing is started when the keyboard device 1000 is powered on.

First, in step S101, the CPU 5 executes initialization processing. In this initialization processing, for example, the CPU 5 sets a default performance into a selected state. In step S102, if there is a user instruction such as edition, new addition, or deletion of a performance, the CPU 5 executes the processing in accordance with the instruction. In step S103, the CPU 5 determines whether a current state is the hold-disabled state. If the current state is not the hold-disabled state, the CPU 5 advances the processing to step S106. If the current state is the hold-disabled state, the CPU 5 determines whether the hold operation (long pressing of the switch 91 or 101) is performed in step S104. If the hold operation is not performed, the CPU 5 advances the processing to step S106. If the hold operation is performed, the CPU 5 switches the state from the hold-disabled state to the hold-enabled state in step S105, and then advances the processing to step S106.

In step S106, the CPU 5 determines whether the current state is the hold-enabled state. If the current state is not the hold-enabled state, the CPU 5 advances the processing to step S109. If the current state is the hold-enabled state, the CPU 5 determines whether the hold release operation (pressing the switch 91 or 101 once) is performed in step S107. If the hold release operation is not performed, the CPU 5 advances the processing to step S109. If the hold release operation is performed, the CPU 5 switches the state from the hold-enabled state to the hold-disabled state in step S108, and then advances the processing to step S109.

In step S109, it is determined whether an operation for switching the selected performance (selection operation performed by the selection switch group 23) is performed. If the switching operation of the performance is not performed, the CPU 5 advances the processing to step S113. If the switching operation of the performance is performed, in step S110, the CPU 5 determines whether the current state is the hold-enabled state. If the current state is the hold-enabled state, the CPU 5 executes step S111, which will be described below, and then advances the processing to step S113. If the current state is not the hold-enabled state, the CPU 5 executes step S112 described below, and then advances the processing to step S113.

In step S111, the CPU 5 switches the performance and maintains the effect setting corresponding to the operator where the hold operation in step S104 is performed. For example, if the operator where the hold operation is performed is the switch 91, the CPU 5 maintains the settings of the delay effect, the insertion effect, and the EQ in the state before the switching. Alternatively, if the operator where the hold operation is performed is the switch 101, the CPU 5 maintains the settings of the reverb effect, the insertion effect, and the EQ in the state before the switching.

In step S112, the CPU 5 switches the performance as usual. Therefore, the settings of delay effect, reverb effect, insertion effect and EQ are switched to settings defined in the performance after the switching.

In step S113, the CPU 5 generates a sound signal having a pitch based on performance data acquired from the performance operator 1 or the storage device 10 for each timbre corresponding to the timbre sections set to be valid in the current performance. At this time, the CPU 5 reflects the effect settings that are set to be valid. In step S114, the CPU 5 generates a sound by outputting the sound signal generated in step S113 to the sound system 15. In step S115, the CPU 5 executes other processing, and then returns the processing to step S102. In the other processing, the CPU 5, for example, performs setting of validity/invalidity of the timbre sections and setting of validity/invalidity of the effects based on an operation of the user. If there is an operation of the user indicating an end instruction, the CPU 5 ends the sound signal output processing as shown in FIG. 7.

According to the present embodiment, even when the performance is switched in the hold-enabled state, the effect setting is maintained in the state before the switching when the sound signal is generated. Therefore, the performer can maintain the effect setting at a desired timing, so that flexibility of the switching of the effect setting can be improved. Even during performance, it is easy to change an effect applied to a sound as desired depending on a situation.

Since the switches 91, 101 serve as both the operators configured to receive the designation of validity/invalidity of the effect and the operators configured to switch between the hold-enabled state and the hold-disabled state, the operators can be effectively used. Moreover, since the switches 91, 101 can receive both the hold operation and the hold release, the performer can easily remember the operation while effectively using the operators.

When the effect setting of the selected performance is temporarily changed, the effect setting is maintained even when the state is switched to the hold-enabled state. Therefore, the effect setting can be flexibly changed and maintained even at a site of performance.

Whether the setting of the delay effect or the reverb effect is to be maintained is determined depending on whether the hold operation is performed on the switch 91 or the switch 101. Therefore, whether to maintain the effect setting can be designated for each type of effect.

In the present embodiment, the object whose setting is maintained in the hold-enabled state is the effect setting. However, the object whose setting is maintained is not limited to the effect setting, and the timbre setting may also be included as an object whose setting is maintained.

A configuration may be provided to notify the performer about whether the current state is the hold-enabled state or the hold-disabled state. For example, lamps are provided on the switches 91, 101. The notification may be performed visually by distinguishing between the hold-enabled state and the hold-disabled state according to a lighting mode or an on/off state of the lamps. For example, lighting of the lamps corresponds to the hold-disabled state of the switches 91, 101, and blinking of the lamps corresponds to the hold-enabled state of the switches 91, 101.

In the present embodiment, the switches 91, 101 are operators configured to switch between the hold-enabled state and the hold-disabled state. However, the configuration configured to switch between the hold-enabled state and the hold-disabled state is not limited thereto, and, for example, a configuration in which setting states can be maintained for each timbre section may be provided. In this case, for example, instead of the switches 91, 101, the switches 31, 51, 71 are used as the operators configured to switch between the hold-enabled state and the hold-disabled state. Various settings in the timbre section to which the switch where the hold operation is performed belongs may be set as an object to be maintained. The various settings described herein may include at least one of timbre, insertion effect and volume. For example, the setting of the insertion effect or the like in the first timbre section 30 is set as the object to be maintained by long pressing of the switch 31. In this case, the setting of the common effect (delay, reverb) may not be the object to be maintained. An effect setting maintaining function realized by the operation of the switches 91, 101 and an effect setting maintaining function realized by the operation of the switches 31, 51, 71 may be simultaneously provided. For example, the common effect may be set as the object to be maintained by the operation of the switches 91, 101, while the insertion effect setting may be set as the object to be maintained by the operation of the switches 31, 51, 71.

A configuration in which the switching processing of the hold-enabled state/hold-disabled state can be set to be valid/invalid may be provided, and the switches 31, 51, 71 may be switched to the hold-enabled state by an operation such as long pressing of the switches 31, 51, 71 only when the switching processing of the hold-enabled state/hold-disabled state is valid. For example, only in a state where "Enable" is set in the main section 20, the state can be switched to the hold-enabled state by an operation such as long pressing of the switches 31, 51, 71. With such a configuration, unintentional switching to the hold-enabled state caused by unintentional long pressing operation can be avoided.

Although the number of the common effects exemplified in the present embodiment is two, the present invention is not limited thereto, and the number thereof may be one or three or more. The type and the number of the insertion effects unique to each timbre section are not limited to those exemplified.

Although the present invention is described in detail based on a preferred embodiment thereof, the present invention is not limited thereto, and various modes without departing from the spirit of the present invention are also included in the present invention.

A storage medium storing a control program represented by the software for achieving the present invention may be read out to the sound control device so as to achieve the same effects as those of the present invention. In this case, a program code read out from the storage medium realizes the novel functions of the present invention, and a non-transitory computer-readable recording medium storing the program code constitutes the present invention. The program code may be supplied via a transmission medium or the like. In this case, the program code constitutes the present invention. In addition to the ROM, a floppy disk, a hard disk, an optical disk, a magneto-optical disk, a CD-ROM, a CD-R, a magnetic tape, a nonvolatile memory card, or the like may be used as the storage medium in these cases. The non-transitory computer-readable recording medium includes a recording medium that retains a program for a certain period of time, such as a volatile memory (for example, a dynamic random access memory (DRAM)) inside a computer system serving as a server or a client when the program is transmitted via a network such as the Internet or a communication line such as a telephone line.

What is claimed is:

1. A sound control device, comprising:

a selector configured to select, based on a user operation, one piece of setting information among a plurality of pieces of setting information including at least one timbre group for a manual sound signal and at least one effect setting group for a manual sound signal;

a sound signal generator configured to generate one manual sound signal based on performance information, and based on the at least one timbre group for the manual sound signal and the at least one effect setting group for the manual sound signal included in the selected setting information;

a switcher configured to switch between a hold-enabled state and a hold-disabled state based on a user operation; and a controller configured to control the sound signal generator to generate the manual sound signal such that in the hold-enabled state, even if the selection of the setting information is switched by the selector, at least an effect setting is maintained, whereas in the hold-disabled state, the effect setting is switched in response to a switch or change in the selection of the setting information by the selector.

2. The sound control device according to claim 1, further comprising:

a designation operator configured to receive designation of validity or invalidity of an effect defined in the selected setting information, wherein the switcher switches between the hold-enabled state and the hold-disabled state based on reception of a user operation received by the designation operator.

3. The sound control device according to claim 2, wherein the switcher switches from the hold-disabled state to the hold-enabled state in response to reception of a first predetermined operation received by the designation operator, the first predetermined operation being different from an operation for designating validity or invalidity of an effect.

4. The sound control device according to claim 3, wherein the switcher switches from the hold-enabled state to the hold-disabled state in response to reception of a second predetermined operation received by the designation operator.

5. The sound control device according to claim 1, further comprising:

a changer configured to receive a change of an effect setting defined in the selected setting information, wherein the controller controls the sound signal generator to generate the manual sound signal such that in a state where the effect setting is changed based on reception of a change received by the changer, when the state is switched to the hold-enabled state, even if the selection of the setting information is switched by the selector, the effect setting is maintained in a changed state based on the reception of the change.

6. The sound control device according to claim 1, wherein a plurality of the switchers are provided, different types of effects are associated with each of the switchers, and when the controller switches the state to the hold-enabled state upon receipt of an operation in the switcher, an effect corresponding to the switcher which receives the operation for switching to the hold-enabled state is a target whose setting state is maintained, while effects corresponding to other switchers are not targets, and the setting states thereof are not maintained.

7. The sound control device according to claim 1, further comprising:

a storage configured to hold the plurality of pieces of setting information; and a creator configured to create new setting information based on a user operation, wherein the storage holds the new setting information created by the creator.

8. The sound control device according to claim 1, wherein the effect setting includes a setting of one type of effect which is common to each of the effect setting groups in the hold-enabled state.

9. The sound control device according to claim 8, wherein the common type effect includes at least one of a reverb or a delay.

10. The sound control device according to claim 1, wherein the effect setting group includes a setting of one type of effect which can be set for each of a plurality of timbres in the at least one timbre group.

11. A sound control method, comprising:

selecting, based on a user operation, one piece of setting information among a plurality of pieces of setting information including at least one timbre group for a manual sound signal and at least one effect setting group for a manual sound signal;

generating one manual sound signal based on performance information, and based on the at least one timbre group for the manual sound signal and the at least one effect setting group for the manual sound signal included in the selected setting information;

switching between a hold-enabled state and a hold-disabled state based on a user operation; and controlling generation of the manual sound signal such that in the hold-enabled state, even if the selection of the setting information is switched, at least an effect setting is maintained, whereas in the hold-disabled state, the effect setting is switched in response to a switch or change in the selection of the setting information.

12. The sound control method according to claim 11, wherein the hold-enabled state and the hold-disabled state are switched based on reception of a user operation received by a designation operator configured to receive designation of validity or invalidity of an effect defined in the selected setting information.

13. The sound control method according to claim 12, wherein the state is switched from the hold-disabled state to the hold-enabled state in response to reception of a first predetermined operation received by the designation operator, the first predetermined operation being different from an operation for designating validity or invalidity of an effect.

14. The sound control method according to claim 13, wherein the state is switched from the hold-enabled state to the hold-disabled state in response to reception of a second predetermined operation received by the designation operator.

15. The sound control method according to claim 11, wherein generation of the manual sound signal is controlled such that in a state where the effect setting is changed based on reception of a change of the effect setting defined in the selected setting information, when the state is switched to the hold-enabled state, even if the selection of the setting information is switched, the effect setting is maintained in a changed state based on the reception of the change.

16. The sound control method according to claim 11, wherein the hold-enabled state and the hold-disabled state are switched based on the user operation by a plurality of switchers associated with different types of effects, and when the state is switched to the hold-enabled state upon reception of an operation of the switcher, an effect corresponding to the switcher which receives the operation for switching to the hold-enabled state is a target whose setting state is maintained, while effects corresponding to other switchers are not targets, and the setting states thereof are not maintained when the manual sound signal is generated.

17. A non-transitory computer-readable medium in which a program configured to execute a sound control method in a computer is stored, wherein the sound control method includes: selecting, based on a user operation, one piece of setting information among a plurality of pieces of setting information including at least one timbre group for a manual sound signal and at least one effect setting group for a manual sound signal;

generating one manual sound signal based on performance information, and based on the at least one timbre group for the manual sound signal and the at least one effect setting group for the manual sound signal included in the selected setting information;

switching between a hold-enabled state and a hold-disabled state based on a user operation; and controlling generation of the manual sound signal such that in the hold-enabled state, even if the selection of the setting information is switched, at least an effect setting is maintained, whereas in the hold-disabled state, the effect setting is switched in response to a switch or change in the selection of the setting information.

* * * * *